US010866541B2

(12) United States Patent
Chertov

(10) Patent No.: US 10,866,541 B2
(45) **Date of Patent: *Dec. 15, 2020**

(54) CLEANING UNIT

(71) Applicant: HP INDIGO B.V., Amstelveen (NL)

(72) Inventor: Igor Chertov, Ness Ziona (IL)

(73) Assignee: HP Indigo B.V., Amstelveen (NL)

( * ) Notice: Subject to any disclaimer, the term of this patent is extended or adjusted under 35 U.S.C. 154(b) by 0 days.

This patent is subject to a terminal disclaimer.

(21) Appl. No.: 16/668,209

(22) Filed: Oct. 30, 2019

(65) Prior Publication Data

US 2020/0064758 A1 Feb. 27, 2020

Related U.S. Application Data

(63) Continuation of application No. 16/072,335, filed as application No. PCT/EP2016/058096 on Apr. 13, 2016, now Pat. No. 10,481,527.

(51) Int. Cl.
*G03G 21/00* (2006.01)
*G03G 15/11* (2006.01)

(52) U.S. Cl.
CPC ..... *G03G 15/11* (2013.01); *G03G 21/0088* (2013.01)

(58) Field of Classification Search
CPC .... G03G 15/10; G03G 15/11; G03G 15/2025; G03G 21/58; G03G 21/88; G03G 221/05
USPC ..... 399/107, 110, 123, 343, 348; 15/1.51, 15/256.5, 256.51
See application file for complete search history.

(56) References Cited

U.S. PATENT DOCUMENTS

| | | | | |
|---|---|---|---|---|
| 5,640,655 | A | 6/1997 | Shoji | |
| 5,970,297 | A | 10/1999 | Gross | |
| 5,978,630 | A | 11/1999 | Chang | |
| 6,108,513 | A | 8/2000 | Landa | |
| 6,134,409 | A | 10/2000 | Staples | |
| 7,010,259 | B2 | 3/2006 | Gila | |
| 7,471,924 | B2 | 12/2008 | Shigezaki | |
| 7,991,343 | B2 | 8/2011 | Izawa | |
| 8,583,021 | B2 | 11/2013 | Kadis | |
| 10,481,527 | B2 * | 11/2019 | Chertov | G03G 21/0088 |
| 2002/0104454 | A1 * | 8/2002 | Verschueren | B41N 3/006 101/450.1 |

* cited by examiner

*Primary Examiner* — Hoan H Tran
(74) *Attorney, Agent, or Firm* — Fabian VanCott

(57) ABSTRACT

A cleaning unit for removing debris from an ink transfer surface includes a cleaning roller having: a microcellular material outer layer; a wetting module to supply cleaning fluid to the microcellular material outer layer of the cleaning roller; and an extractor to remove cleaning fluid and debris from the cleaning roller.

20 Claims, 8 Drawing Sheets

CLEANING UNIT

BACKGROUND

Electrophotographic printing processes, sometimes termed electrostatic printing processes, generally involve creating an image on a photoconductive surface, applying an ink having charged particles to the photoconductive surface, such that they selectively bind to the image, and then transferring the charged particles in the form of the image to a print substrate.

The photoconductive surface may be on a cylinder and is often termed a photo imaging plate (PIP). The photoconductive surface is selectively charged with a latent electrostatic image having image and background areas with different potentials. For example, an electrostatic ink composition including charged toner particles in a liquid carrier can be brought into contact with the selectively charged photoconductive surface. The charged toner particles adhere to the image areas of the latent image while the background areas remain clean. The developed image is then transferred from the photoconductive surface to a print substrate (e.g. paper). The developed image may be transferred from the photoconductive surface to a print substrate directly or, by being first transferred to an intermediate transfer member (ITM), which can be a soft swelling blanket, which is often heated to fuse the solid image and evaporate the liquid carrier, and then to the print substrate.

During the image transfer process, it is desirable that a developed image on an LEP ink transfer surface, such as the photoconductive surface or a surface of the ITM, is completely transferred from the surface to a print substrate, for example from a photoconductive surface to a print substrate via an ITM. However, during a printing process some of the developed image may not be completely transferred, leaving debris, such as fused LEP ink particles on a LEP ink transfer surface. Therefore, it can be necessary to remove debris, e.g. fused LEP ink particles, from an ink transfer surface, such as a photoconductive surface or an ITM. It may also be necessary to remove debris, e.g. LEP ink debris, from a surface of a LEP printing apparatus, such as a photoconductive surface, an ITM surface or a surface of a developer roller of an ink developer unit.

Some existing devices for removing debris from a LEP ink transfer surface, e.g. a photoconductive surface, employ a wetting roller to supply clean cleaning fluid to the surface and a sponge roller to remove debris and cleaning fluid from the surface. During the use of such existing devices, the sponge roller is squeezed following contact with the surface in order to attempt to remove cleaning fluid and debris from the sponge roller. It has been found that removal of debris from the sponge roller of some existing devices may be difficult and/or cause damage to the sponge roller. Incomplete removal of debris from the sponge roller, or damage to the sponge roller may lead to debris being deposited back on the LEP ink transfer surface which may cause degradation in print picture quality and/or damage to the LEP ink transfer surface.

BRIEF DESCRIPTION OF THE FIGURES

Non-limiting examples will now be described with reference to the accompanying drawings, in which.

DETAILED DESCRIPTION

Figure 1A:
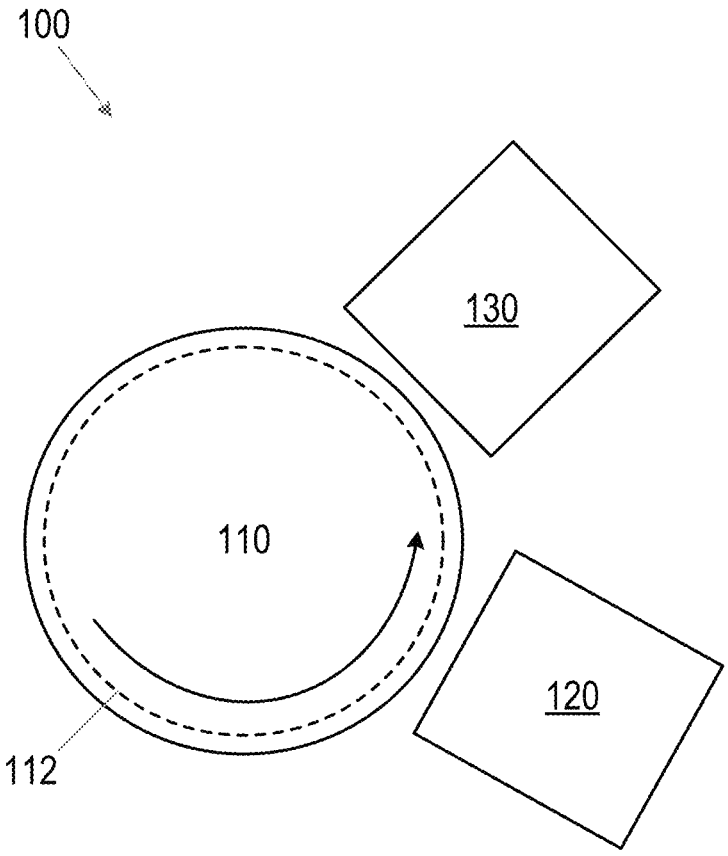
FIG. 1*a* is a schematic illustration of an example of a cleaning unit.

Before the devices, methods and related aspects are disclosed and described, it is to be understood that this disclosure is not restricted to the particular features and materials disclosed herein because such process features and materials may vary somewhat. It is also to be understood that the terminology used herein is used for the purpose of describing particular examples. The terms are not intended to be limiting because the scope is intended to be limited by the appended claims and equivalents thereof.

It is noted that, as used in this specification and the appended claims, the singular forms "a," "an," and "the" include plural referents unless the context clearly dictates otherwise.

As used herein, a "liquid electrophotographic ink" or "LEP ink" generally refers to an ink composition, in liquid form, generally suitable for use in a liquid electrostatic printing process, sometimes termed a liquid electrophotographic (LEP) printing process. The LEP ink may include chargeable particles of a resin and a pigment/colourant dispersed in a liquid carrier, which may be as described herein.

The LEP inks referred to herein may comprise a colourant and a thermoplastic resin dispersed in a carrier liquid. In some examples, the thermoplastic resin may comprise an ethylene acrylic acid resin, an ethylene methacrylic acid resin or combinations thereof. In some examples, the electrostatic ink also comprises a charge director and/or a charge adjuvant. In some examples, the liquid electrostatic inks described herein may be Electrolnk® and any other Liquid Electro Photographic (LEP) inks developed by Hewlett-Packard Company.

The "debris" or "debris particles", referred to herein may comprise "LEP ink debris" and/or dirt/dust particles. The debris particles may have a particle size (volume equivalent sphere diameter), for example an average particle size (average volume equivalent sphere diameter) of at least about 50 μm, for example at least about 100 μm, at least about 150 μm, or about 200 μm. The particle size (volume equivalent sphere diameter) of the debris may be determined using laser diffraction, for example using a Malvern Masterizer 2000. Dirt or dust debris particles may be introduced into a LEP printing apparatus via a print substrate handling system or may be fragments of print substrate, e.g. paper fragments. The "LEP ink debris" may comprise fused LEP ink particles, for example, fused LEP ink particles comprising resin, for example comprising resin and a colourant and/or LEP ink particles comprising resin, in some examples resin and a colourant. In some examples, the "debris" comprises LEP ink debris comprising fused LEP ink particles. Fused LEP ink particles referred to herein may be particles formed on fusing of a LEP ink, for example on the formation of a developed LEP ink image on a photoconductive surface. The fused LEP ink particles may have a particle size (volume equivalent sphere diameter), for example an average particle size (average volume equivalent sphere diameter) of at least about 50 μm, for example at least about 100 μm, at least about 150 μm, or about 200 μm. The particle size (volume equivalent sphere diameter) of the fused LEP ink particles may be determined using laser diffraction, for example using a Malvern Masterizer 2000.

The "LEP ink transfer surface" referred to herein may be any surface within a LEP printing apparatus to which or from which LEP ink may be transferred, for example the surface of any cylindrical component within a LEP printing apparatus to which or from which LEP ink may be transferred. For example, the LEP ink transfer surface may be a photoconductive surface on which a latent electrostatic image may be formed, for example a surface on a cylinder, a surface of an ITM, or a surface of a developer roller of a Binary Ink Developer unit. In some examples, the LEP ink transfer surface is a photoconductive surface.

As used herein, "liquid carrier", "carrier liquid", "carrier," or "carrier vehicle" refers to the fluid in which resin, pigment, charge directors and/or other additives can be dispersed to form a liquid electrostatic ink or electrophotographic ink. The carrier liquid may include a mixture of a variety of different agents, such as surfactants, co-solvents, viscosity modifiers, and/or other possible ingredients. The carrier liquid can include or be a hydrocarbon, silicone oil, vegetable oil, etc. The carrier liquid can include, for example, an insulating, non-polar, non-aqueous liquid that can be used as a medium for the first and second resin components. The carrier liquid can include compounds that have a resistivity in excess of about $10^9$ ohm·cm. The carrier liquid may have a dielectric constant below about 5, in some examples below about 3. The carrier liquid may include hydrocarbons. In some examples, the carrier liquid comprises or consists of, for example, Isopar-G™, IsoparH™, Isopar-L™, Isopar-M™, Isopar-K™, Isopar-V™, Norpar 12™, Norpar 13™, Norpar 15™, Exxol D40™, Exxol D80™, Exxol D100™, Exxol D130™, and Exxol D140™ (each sold by EXXON CORPORATION).

As used herein, "electrostatic(ally) printing" or "electrophotographic(ally) printing" generally refers to the process that provides an image that is transferred from a photo imaging substrate or plate either directly or indirectly via an intermediate transfer member to a print substrate, e.g. a paper substrate. As such, the image is not substantially absorbed into the photo imaging substrate or plate on which it is applied. Additionally, "electrophotographic printers" or "electrostatic printers" generally refer to those printers capable of performing electrophotographic printing or electrostatic printing, as described above. "Liquid electrophotographic printing" is a specific type of electrophotographic printing where a liquid ink is employed in the electrophotographic process rather than a powder toner. An electrostatic printing process may involve subjecting the electrophotographic ink composition to an electric field, e.g. an electric field having a field strength of 1000 V/cm or more, in some examples 1000 V/mm or more.

As used herein, the term "about" is used to provide flexibility to a numerical range endpoint by providing that a given value may be a little above or a little below the endpoint. The degree of flexibility of this term can be dictated by the particular variable.

As used herein, a plurality of items, structural elements, compositional elements, and/or materials may be presented in a common list for convenience. However, these lists should be construed as though each member of the list is individually identified as a separate and unique member.

Unless otherwise stated, any feature described herein can be combined with any aspect or any other feature described herein.

Cleaning Unit

Described herein is a cleaning unit for removing debris particles from a liquid electrophotographic (LEP) ink transfer surface. The cleaning unit may comprise:

a cleaning roller comprising a microcellular material outer layer;

a wetting module to supply cleaning fluid to the cleaning roller; and an extractor to remove cleaning fluid and debris particles from the cleaning roller.

FIG. 1*a* shows a schematic illustration of an example of a cleaning unit 100. The cleaning unit 100 comprises a cleaning roller 110 comprising a microcellular material outer layer 112, a wetting module 120 and an extractor 130. The wetting module 120 may supply cleaning fluid to the microcellular material outer layer 112 of the cleaning roller 110. The microcellular outer layer 112 of the cleaning roller 110 may absorb cleaning fluid applied to the cleaning roller 110. The extractor 130 may remove cleaning fluid and debris (e.g. debris particles) from cleaning roller 110, for example from the microcellular material outer layer 112 of the cleaning roller 110.

A microcellular material as described herein may be a material having micron-sized open cell pores, e.g. an open cell foam, for example pores having diameters in the micron range, for examples open cell pores having a diameter of less than about 50 μm. The microcellular outer layer may comprise open cell pores having a diameter smaller than the particle size of the debris particles. Providing a cleaning roller comprising such a microcellular material has been found to allow for absorption of cleaning fluid by the microcellular outer layer 112 of the cleaning roller 110 and also prevent incorporation of debris particles, such as fused LEP ink particles etc., into the microcellular outer layer 112 of the cleaning roller 110. The microcellular material may be an open cell microcellular material, for example an open cell foam. In some examples, the microcellular material is a microcellular material having a pores having a diameter, for example an average pore diameter, of less than about 50 μm, for example less than about 40 μm, less than about 35 μm, or less than about 30 μm. The pore diameter of a microcellular material may refer to the linear largest distance across a pore of the material. The average pore diameter of a microcellular material may be measured using a digital microscope, for example the diameter of a number of pores, for example 100, or 500 pores, may be measured and the average pore diameter determined. In some examples, a microcellular material has an average pore diameter in the range of about 0.5 μm to about 50 μm, for example about 1 μm to about 50 μm, about 1 μm to about 30 μm, or about 10 μm to about 30 μm. In some examples, at least about 60% of the pores of the microcellular material have a diameter of less than about 50 μm, for example less than about 30 μm. In some examples, at least about 70% of the pores of the microcellular material have a diameter of less than about 50 μm, for example less than about 30 μm. In some examples, at least about 80% of the pores of the microcellular material have a diameter of less than about 50 μm, for example less than about 30 μm. In some examples, at least about 90% of the pores of the microcellular material have a diameter of less than about 50 μm, for example less than about 30 μm. In some examples, at least about 95% of the pores of the microcellular material have a diameter of less than about 50 μm, for example less than about 30 μm. In some examples, at least about 99% of the pores of the microcellular material have a diameter of less than about 50 μm, for example less than about 30 μm.

In some examples the microcellular material may comprise or be composed of a polymer foam. In some examples the microcellular material may comprise or be composed of a polyurethane or polyester foam. Examples of suitable microcellular materials are soft polyurethane foams available from GTK Timek Group, Switzerland (e.g. polyurethane foams GTK.ES.720.260 and GTK.ES.720.250).

In some examples, the microcellular material outer layer 112 has a thickness of less than about 10 mm, for example less than about 5 mm. In some examples, the microcellular material outer layer 112 has a thickness of at least about 0.5 mm, for example at least 1 mm, or at least about 1.5 mm. In some examples, the microcellular material outer layer 112 has a thickness in the range of 1.5 mm to 5 mm.

In some examples, the microcellular material has an Asker C hardness in the range of 10-20.

In some examples, the microcellular material has a density in the range of 0.2 to 0.3 g/cm$^3$, for example 0.24-0.27 g/cm$^3$, or 0.25-0.26 g/cm$^3$.

Figure 1B:
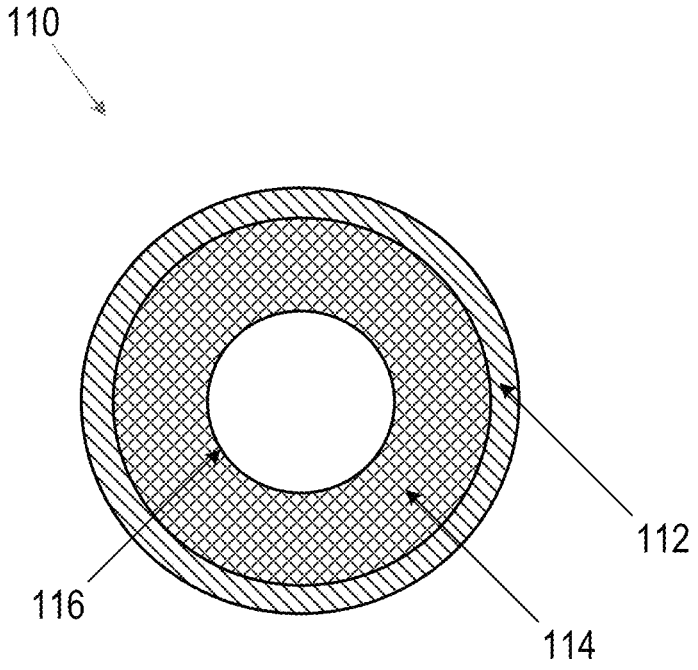
FIG. 1*b* is a schematic illustration of an example of a cleaning roller of a cleaning unit.

The cleaning roller 110 may consist of microcellular material, for example the microcellular material outer layer 112. FIG. 1*b* shows a schematic illustration of an example of a cleaning roller 112. In some examples, the cleaning roller 110 comprises a microcellular material outer layer 112 disposed on a sponge inner layer 114. A sponge inner layer may be provided to increase the compressibility of the cleaning roller 110, for example to increase the compressibility of the cleaning roller 110 on the application of a predetermined force. In some examples, the sponge inner layer is composed of a sponge material. In some examples, the sponge inner layer is composed of an open cell foam. In some examples, the sponge inner layer is composed of a resilient open cell foam. In some examples, the sponge material of the sponge inner layer has a density in the range of 30 to 60 kg/m$^3$, for example 40-50 kg/m$^3$. In some examples, the sponge inner layer is composed of a sponge having an average pore size of greater than about 400 μm, for example greater than about 500 μm, or greater than about 1000 μm. In some examples the sponge of the inner sponge layer comprises or consists of a polymer foam, for example a polyurethane foam or a polyether polyurethane foam. Examples of suitable sponge materials are polyether polyurethane foams available from GTK Timek Group, Switzerland (e.g. polyether polyurethane foam GTK ES-725.45).

The cleaning roller 110 may comprise a core 116, for example a cylindrical core, composed of a non-porous material such as metal, e.g. aluminium, or plastic. The cleaning roller 110 may comprise a microcellular material outer layer 112 disposed on a sponge inner layer 114 disposed on a core 116.

The microcellular outer layer 112 and the sponge inner layer 114 of the cleaning roller 110 may absorb cleaning fluid applied to the cleaning roller 110.

The extractor 130 may remove cleaning fluid and debris particles from the microcellular material outer layer 112 of the cleaning roller 110 and remove cleaning fluid from the sponge inner layer 114 of the cleaning roller 110.

Figure 2:
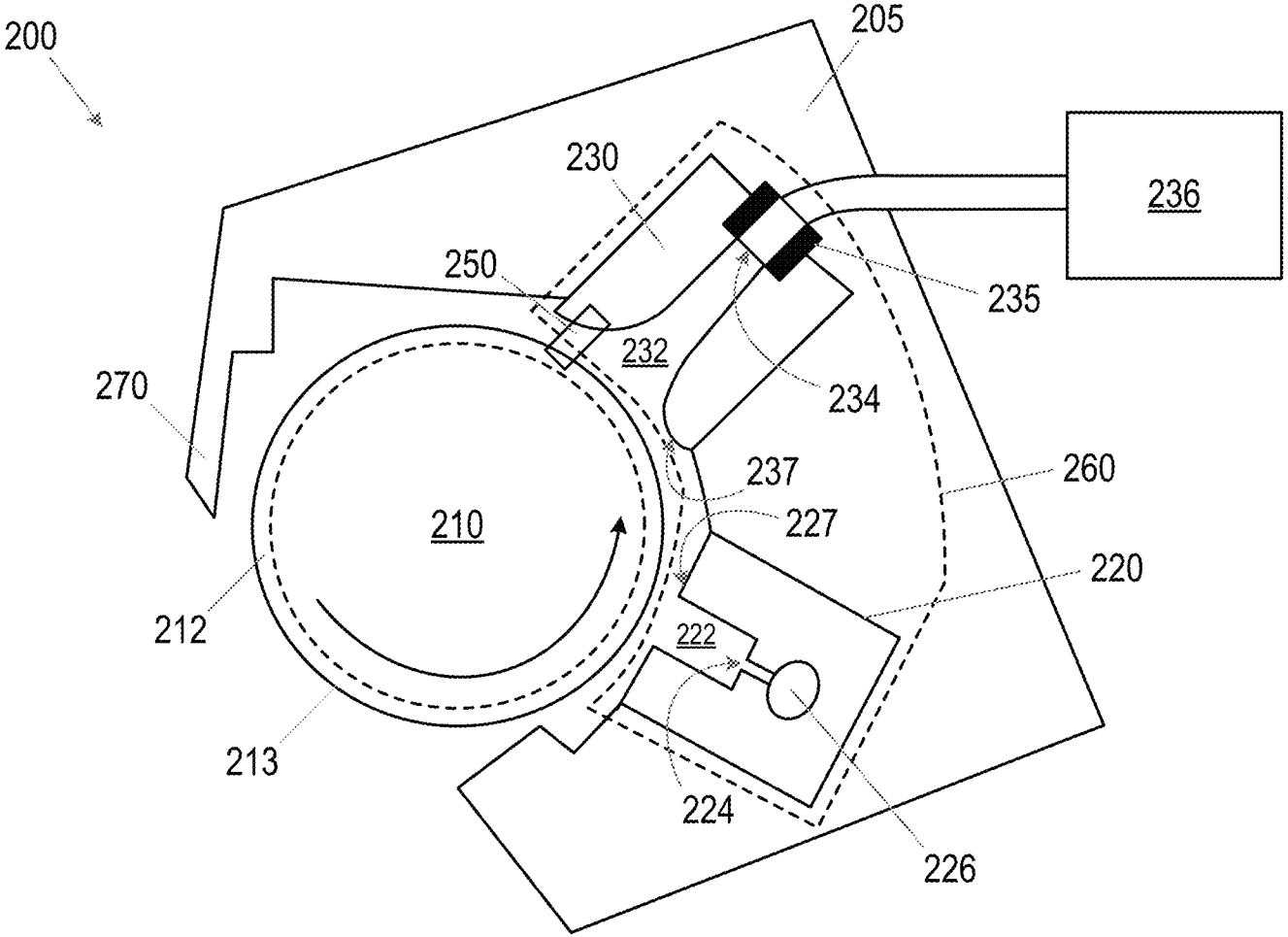
FIG. 2 is a schematic illustration of an example of a cleaning unit.

FIG. 2 shows a schematic illustration of an example of a cleaning unit 200. The cleaning unit 200 comprises a cleaning roller 210 comprising a microcellular material outer layer 212, a wetting module 220 and an extractor 230. The cleaning unit 200 may comprise a housing 205 for supporting the cleaning roller 210, the wetting module 220 and the extractor 230.

Reference numerals used in FIG. 2 which correspond to the reference numerals used in FIG. 1*a* designate the features described above in relation to FIG. 1*a*. For example, the cleaning unit 100 of FIG. 1*a* corresponds to the cleaning unit 200 shown in FIG. 2.

Cleaning fluid may be injected, sprayed or otherwise applied onto the cleaning roller 210 from the wetting module 220. The wetting module 220 may supply cleaning fluid directly to the cleaning roller. The wetting module 220 may comprise a cleaning fluid supply duct 222 for supplying cleaning fluid to the cleaning roller 210. Cleaning fluid may be supplied to the wetting module 220 through inlet 226. For example, cleaning fluid may be supplied to the cleaning roller 210 from inlet 226 via a cleaning fluid nozzle 224, or a plurality of cleaning fluid nozzles 224, and the fluid supply duct 222. Cleaning fluid may be applied to the cleaning roller 210 directly from the fluid supply duct 222 of the wetting module. The cleaning roller, for example the microcellular outer layer 212 of the cleaning roller may absorb cleaning fluid supplied by the wetting module, for example from the fluid supply duct 222 of the wetting module. For example, the fluid supply duct 222 of the wetting module 220 may be filled with cleaning fluid and the cleaning roller may absorb cleaning fluid directly from the fluid supply duct 222 of the wetting module 220. The cleaning fluid may be an imaging oil, for example a carrier liquid used in an electrostatic ink composition. In some examples, the cleaning fluid can include or be a hydrocarbon, silicone oil, vegetable oil, etc. The cleaning fluid can include, for example, an insulating, non-polar, non-aqueous liquid. The cleaning fluid may include hydrocarbons. In some examples, the cleaning fluid comprises or consists of, for example, Isopar-G™, Isopar-H™, Isopar-L™, Isopar-M™, Isopar-K™, IsoparV™, Norpar 12™, Norpar 13™, Norpar 15™, Exxol D40™, Exxol D80™, Exxol D100™, Exxol D130™, and Exxol D140™ (each sold by EXXON CORPORATION). The cleaning unit 200 may comprise a cleaning fluid supply controller to control the rate at which cleaning fluid is supplied from the cleaning fluid inlet 226 to the cleaning fluid supply duct 222. For example, the cleaning fluid supply controller may control the rate at which cleaning fluid is supplied to the cleaning fluid supply duct 222 such that the cleaning roller is not oversaturated (e.g. the cleaning roller may be saturated with cleaning fluid when the cleaning roller can absorb no more cleaning fluid such that additional cleaning fluid applied to the cleaning roller may drip from the cleaning roller rather than being held within the cleaning roller, for example within the sponge inner layer 214 and/or the microcellular outer layer 212) with cleaning fluid. Controlling the amount of cleaning fluid supplied to the cleaning roller 210 may prevent excess cleaning fluid dripping onto the LEP ink transfer surface.

In some examples, the extractor 230 comprises an extractor duct 232 through which debris and cleaning fluid may be removed from the microcellular outer layer 212, for example from the surface 213 of the microcellular outer layer 212. In some examples the extractor duct 232 is in fluid communication with a vacuum source 236 to generate a pressure gradient to remove debris, for example debris and cleaning fluid, from the microcellular outer layer 212 of the cleaning roller 210. For example, the vacuum source 236 may generate a pressure gradient such that debris and cleaning fluid is removed, e.g. sucked away, from a surface 213 of the microcellular outer layer 212 away from the cleaning roller 210. The extractor 230 may comprise a vacuum nozzle 234, or a plurality of vacuum nozzles 234, to which a vacuum source 236 is connectable. For example, a vacuum source 236 may be connectable to a or each vacuum nozzle of the extractor 230 via a, or a plurality of, pneumatic fitting 235. The or each pneumatic fitting may provide for an air tight seal between the or each vacuum nozzle and the vacuum source 236.

In some examples, the cleaning unit 200 comprises a scrubber 250 engageable with the cleaning roller, for example to scrape against the cleaning roller 210, e.g. the microcellular outer layer 212 of the cleaning roller 210, to aid removal of debris from the cleaning roller. The scrubber 250 may aid removal of debris, for example fused LEP ink particles and cleaning fluid, from the cleaning roller 210. The scrubber 250 may be a blade moveable in relation to the cleaning roller 210, for example moveable in relation to the surface 213 of the cleaning roller 210. In some examples, the scrubber 250 may be formed of a solid material, e.g. plastic such as polyurethane having a Shore A hardness of around 70-85. The scrubber 250 may be positioned within the extractor 230, for example within the extractor duct 232, to work against the microcellular outer layer 212, for example the surface 213 of the microcellular outer layer 212, for example to aid removal of debris from the surface 213 of the microcellular outer layer 212.

In some examples, the cleaning unit 200 comprises a wiper blade 270. The wiper blade may remove residual cleaning fluid (for example cleaning fluid remaining on the cleaning roller after removal of cleaning fluid and debris by extractor 230) from a LEP ink transfer surface which has been applied to the LEP ink transfer surface by the cleaning roller 210 and/or spread out residual cleaning fluid on a photoconductive surface which has been applied to the LEP ink transfer surface by the cleaning roller 210 such that a layer of cleaning fluid, for example having a predetermined, and in some examples uniform, thickness is left on the photoconductive surface. In some examples, the wiper blade 270 is connected to or integral with the housing 205 of the cleaning unit. In some examples, the wiper blade 270 is positioned within the cleaning unit such that when the cleaning roller 210 is brought into contact with a LEP ink transfer surface, the wiper blade 270 is juxtaposed to the photoconductive surface, in some examples spaced from the photoconductive surface by a distance of less than 50 μm, for example less than 30 μm. In some examples, the wiper blade 270 may be formed of a solid material, e.g. plastic such as polyurethane having a Shore A hardness of around 70-85.

The cleaning roller 210 of the cleaning unit is rotatable. The cleaning roller 210 may be rotatable against a LEP ink transfer surface. In some examples, the cleaning unit 200 comprises a motor to rotate the cleaning roller 210. The cleaning unit 200 may comprise a motor controller to control the speed at which the cleaning roller 210 is rotated relative to the LEP ink transfer surface. In some examples the cleaning roller 210 is moveable from between a non-contact position in which the cleaning roller 210 does not contact a LEP ink transfer surface and a contact position in which the cleaning roller 210 contacts a LEP ink transfer surface. In some examples, the cleaning roller 210 may be moveable relative to the housing 205 of the cleaning unit 200.

The extractor 230 and the wetting module 220 of the cleaning unit may be connected, e.g. integrally formed, or connectable to form a cleaning fluid module 260 which may supply cleaning fluid to the cleaning roller 210 of the cleaning unit 200 through the wetting module 220 and remove cleaning fluid along with debris from the cleaning roller 210 through the extractor 230.

Figure 3:
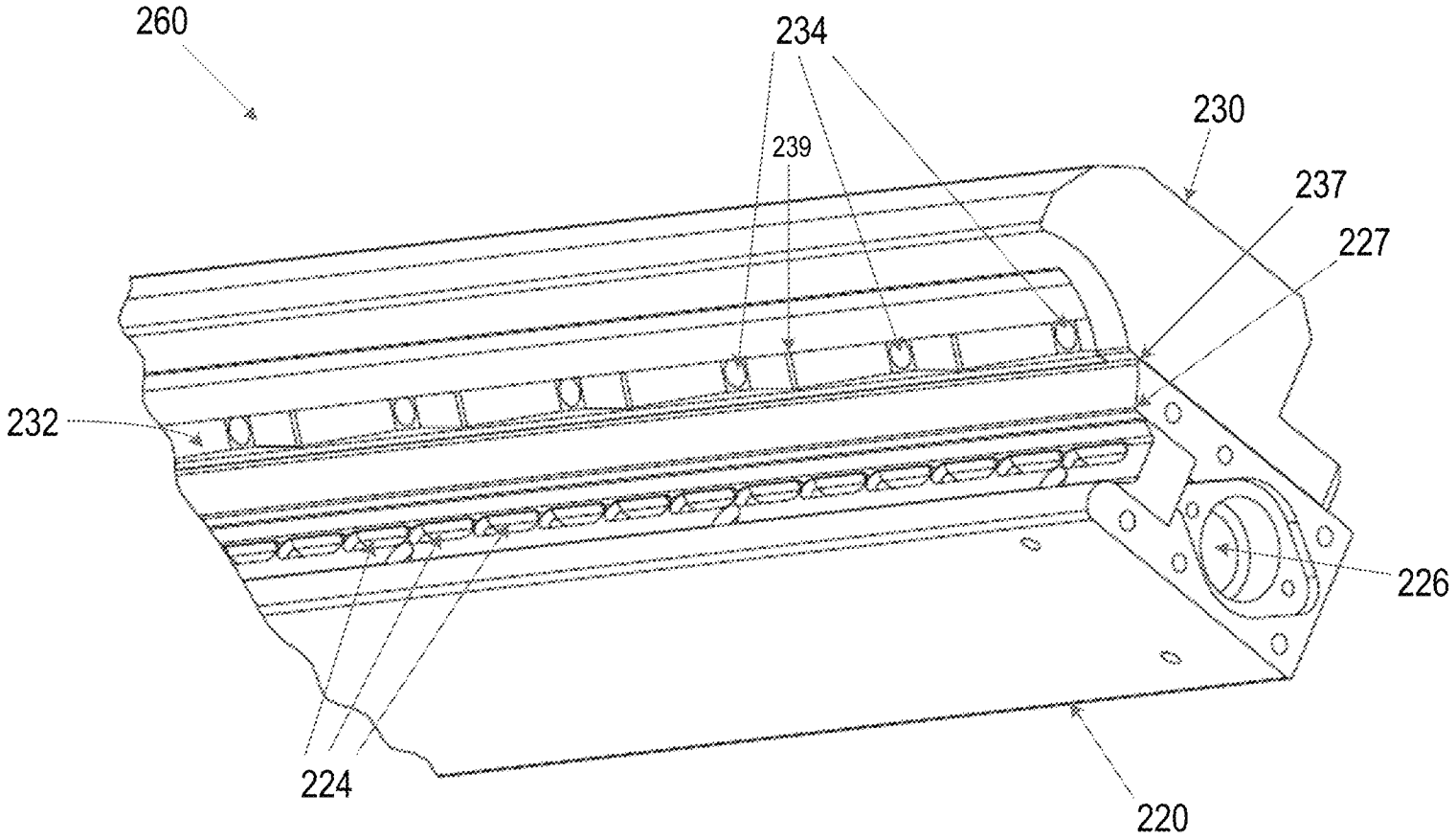
FIG. 3 is a schematic illustration of an example of a wetting module and extractor of a cleaning unit.
Figure 4:
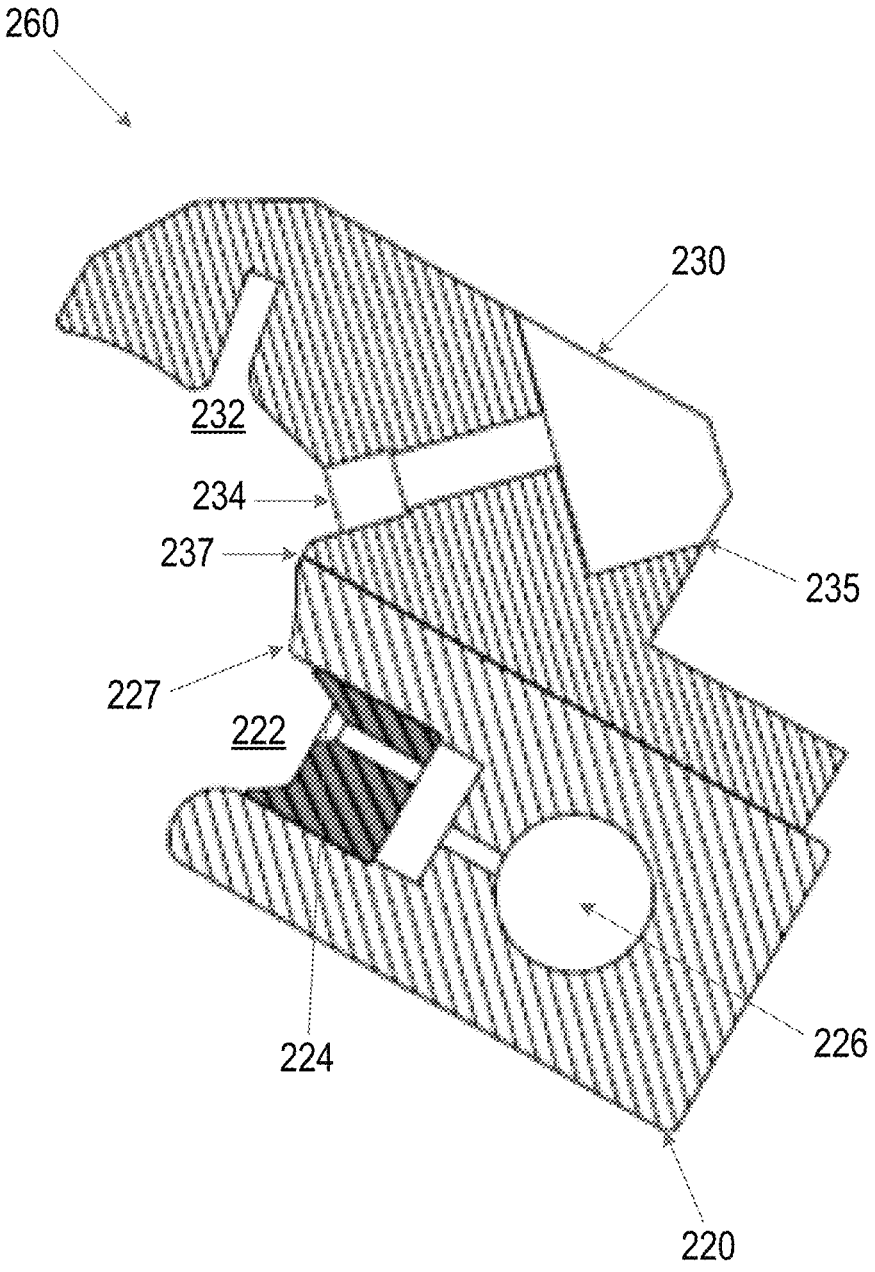
FIG. 4 is a schematic illustration of an example of a wetting module and extractor of a cleaning unit.

FIGS. 3 and 4 are schematic illustrations of an example of cleaning fluid module 260. In these examples, the wetting module 220 comprises a cleaning fluid supply duct 222 supplied with cleaning fluid from a plurality of cleaning fluid nozzles 224 for supplying cleaning fluid to the microcellular outer layer 212 of the cleaning roller 210. Cleaning fluid may be supplied to the cleaning fluid supply duct 222 from the cleaning fluid inlet 226 via the cleaning fluid nozzles 224. In the example illustrated in FIG. 3, the extractor 230 comprises a plurality of vacuum nozzles 234 which are connectable to a vacuum source via pneumatic fittings 235. As illustrated in FIG. 3, the extractor duct 232 may form a vacuum chamber within the extractor 230. The vacuum chamber may have a waved form, for example such that the distance between a vacuum nozzle 234 and the surface 213 of the cleaning roller is greater than the distance between a point on a wall 239 of the vacuum chamber positioned between adjacent vacuum nozzles 324, as shown in FIG. 3, to prevent stagnation points between adjacent vacuum nozzles 234.

In some examples, the extractor 230 and the wetting module 220 of the cleaning unit 200, may be positioned such that an extractor duct leading edge 237 and cleaning fluid supply duct trailing edge 227 are separated by a predetermined distance (e.g. gap 240 shown in FIG. 3). Positioning of the extractor 230 and the wetting module 220 of the cleaning unit 200 such that an extractor duct leading edge 237 and cleaning fluid supply duct trailing edge 227 are separated by a predetermined distance may allow for improved air flow to the extractor 230 when a vacuum source 236 is provided. Positioning of the extractor 230 and the wetting module 220 of the cleaning unit 200 such that an extractor duct leading edge 237 and cleaning fluid supply duct trailing edge 227 are separated by a predetermined distance may allow for creation of a high shear force area as a vacuum source 236 is applied to the extractor 230 to generate a pressure gradient to remove cleaning fluid and debris from the cleaning roller 210.

In some examples, the cleaning roller 210 of the cleaning unit is rotatable such that, for example after contact with an ink transfer surface, a point on the surface 213 of the cleaning roller 210 passes the wetting module 220 prior to passing the extractor 230, e.g. prior to reaching the vacuum chamber 232 of the extractor 230. For example, the wetting module 220 and the extractor 230 may be positioned within the cleaning unit 200 and the cleaning roller 210 rotatable such that on rotation of the cleaning roller a point on the surface 213 of the cleaning roller, after contact with an ink transfer surface, passes the wetting module 220 before passing the extractor 230. This arrangement allows cleaning fluid, along with debris, to be removed from the cleaning roller 210 before the point on the surface 213 of the cleaning roller 210 re-contacts the ink transfer surface.

Reference numerals used in FIGS. 3 and 4 which correspond to the reference numerals used in FIGS. 1*a*, 1*b* and 2 designate the features described above in relation to FIGS. 1*a*, 1*b* and 2.

Method for Removing Debris from a LEP Ink Transfer Surface

Described herein is a method for removing debris from a LEP ink transfer surface. The method may comprise:

providing a cleaning roller comprising a microcellular material outer layer;

contacting the microcellular material outer layer of the cleaning roller with a LEP ink transfer surface to transfer debris particles from the LEP ink transfer surface to the cleaning roller;

wetting the cleaning roller with a cleaning fluid; and removing cleaning fluid and debris particles from the microcellular material outer layer of the cleaning roller.

Figure 5:
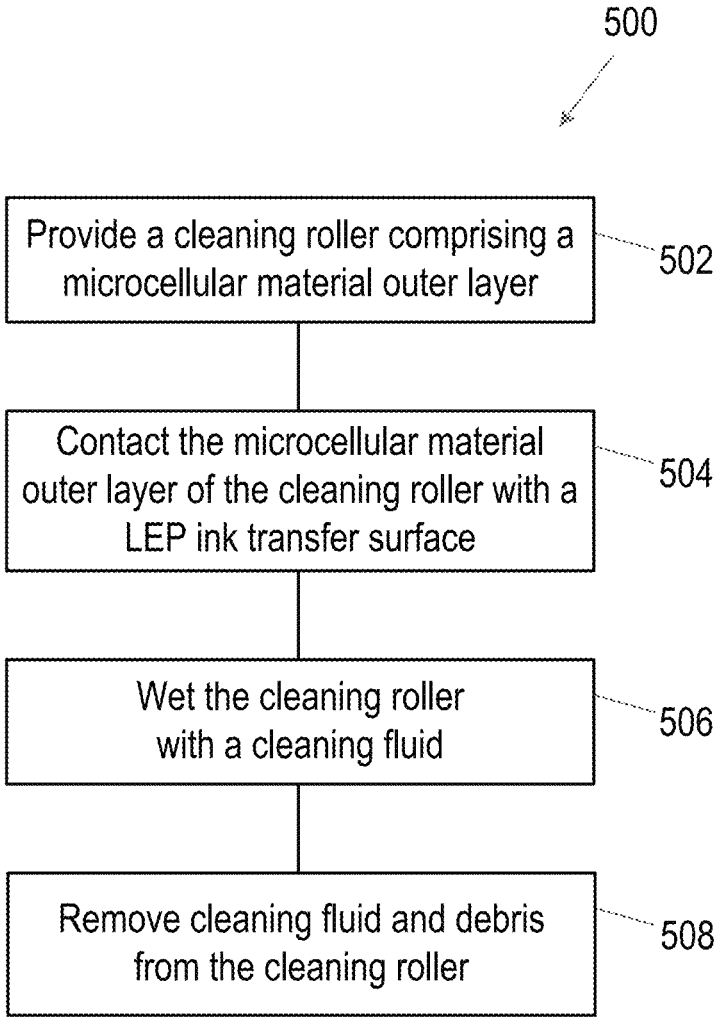
FIG. 5 is an example of a method for removing debris from a LEP ink transfer surface.

FIG. 5 is an example of a method 500 for removing debris (e.g. debris particles) from a LEP ink transfer surface. Block 502 comprises providing a cleaning roller comprising a microcellular material outer layer. Providing a cleaning roller may also comprise rotating a cleaning roller, for example rotating a cleaning roller relative to a LEP ink transfer surface. As discussed above, the cleaning roller may comprise a microcellular material outer layer comprising open cell pores having a diameter smaller than the particle size of the debris particles to be removed from the LEP ink transfer surface.

Block 504 comprises contacting the microcellular material outer layer of the cleaning roller with a LEP ink transfer surface to transfer debris from the LEP ink transfer surface to the cleaning roller. Contacting the microcellular material outer layer of the cleaning roller with a LEP ink transfer surface may comprise moving the cleaning roller from a non-contact position to a contact position such that the microcellular outer layer of the cleaning roller contacts the LEP ink transfer surface. In some examples, contacting the microcellular material outer layer of the cleaning roller with a LEP ink transfer surface comprises moving the cleaning roller from a non-contact position to a contact position. In some examples, moving the cleaning roller from a non-contact position to a contact position comprises moving the cleaning unit from a disengaged position to an engaged position. In some examples, the method comprises contacting the cleaning roller with the LEP ink transfer surface such that the cleaning roller is compressed. In some examples, the method comprises contacting the cleaning roller with the LEP ink transfer surface and compressing the cleaning roller into the LEP ink transfer surface, for example such that the cleaning roller is moved at least about 1 mm towards the LEP ink transfer surface after a point at which the surface of the cleaning roller and the LEP ink transfer surface first come in to contact. In some examples, the cleaning roller is moved at least about 2 mm towards the LEP ink transfer surface after a point at which the surface of the cleaning roller and the LEP ink transfer surface first come in to contact, for example at least about 3 mm, or about 3.5 mm. In some examples, the method comprises rotating the cleaning roller, for example the compressed cleaning roller, against the LEP ink transfer surface. In some examples, the method comprises rotating the cleaning roller against the LEP ink transfer surface such that the cleaning roller and the LEP ink transfer surface rotate in opposite directions at a point at which the cleaning roller and the LEP ink transfer surface contact one another.

Block 506 comprises wetting the cleaning roller with a cleaning fluid. Wetting the cleaning roller with a cleaning fluid may comprise directly applying cleaning fluid to the cleaning roller, for example to the microcellular outer layer of the cleaning roller. Directly applying cleaning fluid to the cleaning roller may comprise rotating the cleaning roller within a cleaning fluid supply duct, for example such that the cleaning roller, e.g. the microcellular outer layer and/or a sponge inner layer of the cleaning roller, absorbs cleaning fluid from the cleaning fluid supply duct. Wetting the cleaning roller with a cleaning fluid may comprise applying cleaning fluid to the cleaning roller such that the cleaning roller is just saturated with cleaning fluid, for example applying cleaning fluid to the cleaning roller such that the saturation level of the cleaning roller is 100% or less. For example, applying cleaning fluid to the cleaning roller such that the saturation level of the cleaning roller is at least about 60%, for example at least about 70%. In some examples, the method comprises applying cleaning fluid to the cleaning roller such that the saturation level of the cleaning roller is at least about 60%, for example at least about 70%. In some examples, the method comprises applying cleaning fluid to the cleaning roller such that the saturation level of the cleaning roller is in the range from about 60% to about 99%, for example from about 70% to about 90%, or from about 70% to about 85% (wherein at 100% saturation the cleaning roller, e.g. the microcellular outer layer and the sponge inner layer of the cleaning roller, is able to absorb no more cleaning fluid).

In some examples, the method comprises controlling the amount of cleaning fluid supplied to the cleaning roller. For example, the flow of cleaning fluid supplied to the cleaning roller may be controlled such that the cleaning roller is not oversaturated with cleaning fluid (e.g. the cleaning roller may be saturated with cleaning fluid when the cleaning roller can absorb no more cleaning fluid such that additional cleaning fluid applied to the cleaning roller may drip from the cleaning roller rather than being held within the cleaning roller, for example within the sponge inner layer and/or the microcellular outer layer). In some examples, the method comprises controlling the amount of cleaning fluid supplied to the cleaning roller to provide a cleaning roller with a cleaning fluid saturation level of at least about 70%, for example about 70% to about 90%.

In some examples, the method comprises contacting the cleaning roller with the LEP ink transfer surface prior to wetting the cleaning roller with cleaning fluid. In some examples, the method comprises removing cleaning fluid and debris from the wetted cleaning roller prior to subsequent contact of the cleaning roller with the LEP ink transfer surface.

Block 508 comprises removing cleaning fluid and debris, e.g. debris partilces comprising fused LEP ink particles, from the cleaning roller, e.g the microcellular material outer layer of the cleaning roller. Removing cleaning fluid and debris from the cleaning roller may comprise providing a vacuum source to generate a pressure gradient such that debris and cleaning fluid are sucked away from the cleaning roller, e.g. away from the microcellular material outer layer of the cleaning roller. For example, removing cleaning fluid and debris from the cleaning roller may comprise applying a vacuum to suck cleaning fluid from the inner sponge layer and the microcellular material layer of the cleaning roller through the surface of the microcellular material layer and suck debris from the surface of the microcellular material layer. Removing cleaning fluid and debris from the cleaning roller may comprise removing debris from an outer surface of the microcellular outer layer of the cleaning roller and removing cleaning fluid from a sponge inner layer and the microcellular outer layer of the cleaning roller. It has been found that wetting the cleaning roller with a cleaning fluid improves removal of debris, for example improves the removal of debris from the cleaning roller.

Removing cleaning fluid and debris from the cleaning roller may comprise providing a vacuum chamber surrounding a section of the cleaning roller, the vacuum chamber may be in communication with a vacuum source and shaped such that a uniform under pressure is generated in the vacuum chamber.

The method may comprise deposition of residual cleaning fluid onto the LEP ink transfer surface, for example the cleaning roller may deposit residual cleaning fluid, for example cleaning fluid remaining on the cleaning roller after removal of cleaning fluid and debris from the cleaning roller, onto the LEP ink transfer surface. For example, residual cleaning fluid may be transferred to the LEP ink transfer surface as the cleaning roller rotates against the LEP ink transfer surface. The method may also comprise removal of residual cleaning fluid from the LEP ink transfer surface. For example, the method may comprise removal of residual cleaning fluid from the LEP ink transfer surface such that a layer of residual cleaning fluid remaining on the LEP ink transfer surface following removal of cleaning fluid from the LEP ink transfer surface has a uniform thickness of less than about 50 μm, for example about 30 μm or less. Removal of residual cleaning fluid from the LEP ink transfer surface may comprise providing a wiper blade, for example providing a wiper blade positioned a pre-determined distance from the LEP ink transfer surface to remove cleaning fluid from the LEP ink transfer surface, for example to leave a uniform layer of cleaning fluid on the LEP ink transfer surface having a pre-determined thickness. In some examples the wiper blade may be positioned less than about 50 μm from the LEP ink transfer surface, for example about 30 μm or less from the LEP ink transfer surface, or about 30 μm from the LEP ink transfer surface.

Electrophotographic Printing Apparatus

Described herein is a liquid electrophotographic printing apparatus. The liquid electrophotographic printing apparatus may comprise:

a LEP ink transfer surface; and a cleaning unit for removing debris particles from the LEP ink transfer surface, the cleaning unit comprising:

a cleaning roller comprising a microcellular material outer layer contactable with the LEP ink transfer surface;

a wetting module to supply cleaning fluid to the cleaning roller; and an extractor to remove cleaning fluid and debris particles from the cleaning roller.

Figure 6:
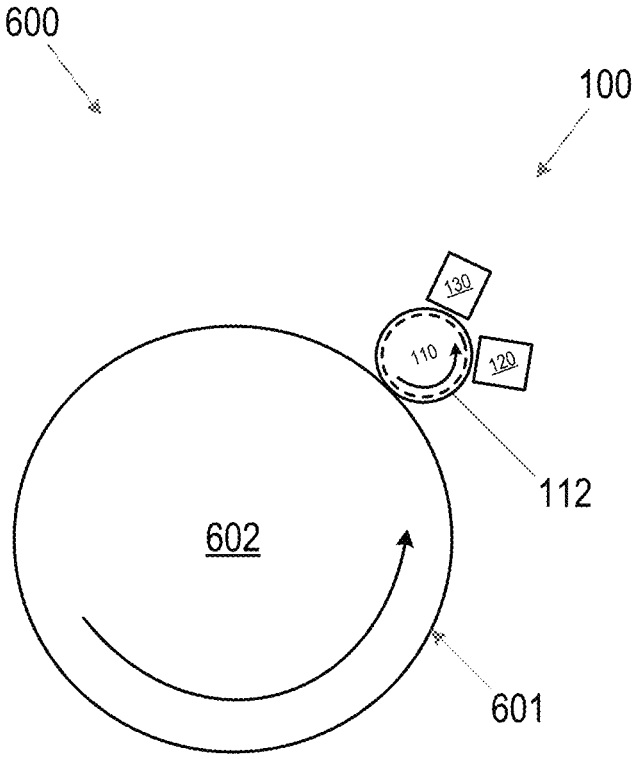
FIG. 6 is a schematic illustration of an example of a liquid electrostatic printing apparatus.
Figure 7:
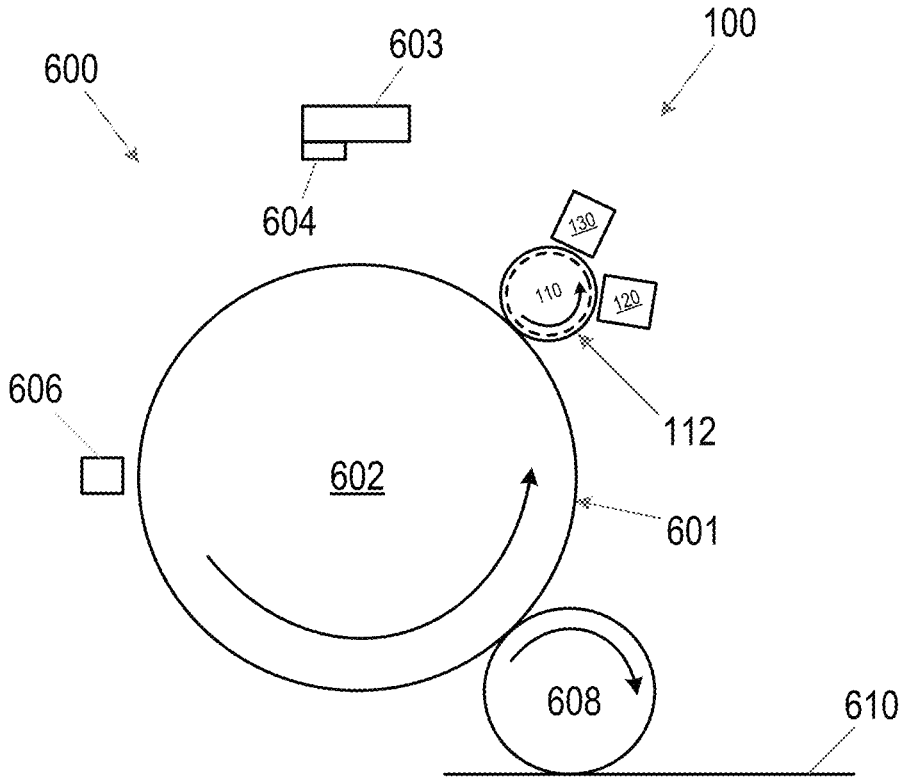
FIG. 7 is a schematic illustration of an example of a liquid electrostatic printing apparatus.

FIGS. 6 and 7 are schematic illustrations of a liquid electrophotographic printing apparatus 600 comprising a LEP ink transfer surface 601 and a cleaning unit 100. The example of a LEP printing apparatus 600 illustrated in FIG. 6 may comprise an ITM or a photoconductive member having a surface 601. The example of a LEP printing apparatus 600 illustrated in FIG. 7 comprises a photoconductive surface 601 as the LEP ink transfer surface. The cleaning unit 100 may be as described above (the cleaning unit 100 may correspond to the cleaning unit 100 shown and described in relation to FIGS. 1*a* and/or 1*b* and/or the cleaning unit 200 shown and described in relation to FIGS. 2-4). The cleaning unit may comprise a cleaning roller comprising a microcellular material outer layer comprising open cell pores having a diameter smaller than the particle size of the debris particles.

The LEP ink transfer surface may be on a cylinder, for example a photo imaging plate (PIP) drum 602. The liquid electrophotographic printing apparatus 600 may comprise a photo charging unit 603, a laser imaging portion 604 and a Binary Ink Developer (BID) unit 606. In some examples, the liquid electrophotographic printing apparatus may also comprise an intermediate transfer member (ITM) 608.

In an alternative example, the cleaning unit 100 may be positioned such that the cleaning roller is contactable with a surface of the ITM 608 to remove debris from the ITM 608.

According to an illustrative example of using a liquid electrostatic printing apparatus to print a LEP ink, firstly, the photo charging unit 603 deposits a uniform static charge on the photoconductive surface 601 and then a laser imaging portion 604 of the photo charging unit 603 dissipates the static charges in selected portions of the image area on the photoconductive surface 601 to leave a latent electrostatic image. The latent electrostatic image is an electrostatic charge pattern representing the image to be printed. The LEP ink composition is then transferred to the photoconductive surface 601 by Binary Ink Developer (BID) unit 606. The BID unit 606 presents a uniform film of the LEP ink to the photoconductive surface 601. A resin component of the LEP ink may be electrically charged by virtue of an appropriate potential applied to the electrostatic ink composition in the BID unit. The charged resin component, by virtue of an appropriate potential on the electrostatic image areas, is attracted to the latent electrostatic image on the photoconductive surface 601 (first transfer). The LEP ink does not adhere to the uncharged, non-image areas and forms an image on the surface of the latent electrostatic image. The photoconductive surface 601 then has a developed LEP ink image on its surface.

The developed LEP ink image may then transferred from the photoconductive surface 601 to the intermediate transfer member (ITM) 608 by virtue of an appropriate potential applied between the photoconductive surface 601 and the ITM 608, such that the charged LEP ink is attracted to the ITM 608 (second transfer). The image is then dried and fused on the ITM 608 before being transferred to a print substrate 610.

Between the first and second transfers the solid content of the LEP ink image is increased and the LEP ink is fused on to the ITM 608. For example, the solid content of the LEP ink image deposited on the ITM 608 after the first transfer may be around 20%, by the second transfer the solid content of the image may be around 80-90%. This drying and fusing may be achieved by using elevated temperatures, for examples temperatures above about 80° C., for example above about 100° C., e.g. a temperature in the range of about 80-120° C., e.g. about 110° C. and air flow assisted drying. In some examples, the ITM 608 is heatable During the image transfer process, some of the developed LEP ink image may not be transferred from the photoconductive surface leaving fused LEP ink particles on the photoconductive surface. Therefore, following the transfer of the developed LEP ink image from the photoconductive surface 601, e.g. to the ITM 608 and/or the print substrate 610, the cleaning unit 100 may be engaged such that the cleaning roller 110 contacts the photoconductive surface 601.

The cleaning unit may be moveable within the liquid electrophotographic printing apparatus between a disengaged position in which the cleaning roller is spaced form the photoconductive surface and an engaged position in which the cleaning roller contacts the photoconductive surface in order to remove debris from the photoconductive surface. For example, the LEP printing apparatus may be operable to print LEP ink images, for example onto a print substrate, when the cleaning using is in the disengaged position. The LEP printing apparatus may be operable for cleaning, in some examples and not printing LEP ink images, when the cleaning unit is in the engaged position.

The LEP printing apparatus may comprise a cleaning unit stop with which the cleaning unit engages in the contact position. The cleaning unit stop may be position such that when the cleaning unit is moved such that the cleaning unit engages with the cleaning unit stop the cleaning roller is compressed against the LEP ink transfer surface, e.g. the photoconductive surface, for example such that the cleaning roller is moved at least about 1 mm towards the LEP ink transfer surface after a point at which the surface of the cleaning roller and the LEP ink transfer e surface first come in to contact, in some examples at least about 2 mm towards the LEP ink transfer surface after a point at which the surface of the cleaning roller and the LEP ink transfer surface first come in to contact, for example at least about 3 mm, or about 3.5 mm.

In some examples, a LEP ink image may be formed on a print substrate as described above. In some examples, the method of forming a LEP ink image may comprise cleaning the surface of the photoconductive surface after each transfer of a developed LEP ink image from the photoconductive surface. In some examples, the method of forming a LEP ink image may comprise cleaning the surface of an ITM after each transfer of a developed LEP ink image from the ITM to a print substrate.

EXAMPLES

The following illustrates examples of the compositions and related aspects described herein. Thus, these examples should not be considered to restrict the present disclosure, but are merely in place to teach how to make examples of compositions of the present disclosure.

A cleaning roller was provided having an aluminium core, an inner sponge layer composed of polyether polyurethane foam (polyether polyurethane foam GTK ES-725.45, available from GTK Timek Group, Switzerland) having a thickness of 7 mm with a microcellular outer layer having an open cell structure with an average pore diameter of 10-30 μm composed of polyurethane foam (GTK.ES.720.260 available from GTK Timek Group, Switzerland) having a thickness of 2 mm disposed on the inner sponge layer which was in turn disposed on the aluminium core.

A cleaning roller was provided having an aluminium core and a sponge layer composed of polyether polyurethane foam (polyether polyurethane foam GTK ES-725.45, available from GTK Timek Group, Switzerland) having a thickness of 9 mm. The sponge layer formed the outer layer of the cleaning roller.

The cleaning performance of the two cleaning rollers was compared by preparing a dirty photoconductive surface by printing 100 impressions of grey 20% black LEP ink images without cleaning the photoconductive surface and then wiping a cleaning roller over the dirty photoconductive surface on which fused LEP ink particles were disposed. The cleaning rollers were then washed in cleaning fluid (Isopar L) and squeezed by hand to remove the cleaning fluid. After cleaning and squeezing the cleaning rollers were observed by the human eye. The cleaning roller having a microcellular outer layer was clean, i.e. did not contain fused black LEP ink particles, while the cleaning roller having a sponge outer layer contained fused black LEP ink particles which may be returned to the photoconductive surface when subsequently contacted with the photoconductive surface.

The present inventors also found that when each of the cleaning rollers, dirtied as described above and saturated with cleaning fluid, were inserted into a cleaning unit comprising a wetting module and extractor unit, as illustrated in FIG. 2, and the extractor unit was connected to a vacuum source, the cleaning fluid and fused black LEP ink particles was successfully removed from the roller having the microcellular outer layer, but the fused black LEP ink particles remained visible on the cleaning roller having the sponge outer layer.

The present inventors have also found that the provision of an extractor in communication with a vacuum source prevents contamination of the cleaning unit over time, due to preventing build up of LEP ink debris, e.g. fused LEP ink particles, within the cleaning unit housing.

While the method, apparatus and related aspects have been described with reference to certain examples, it will be appreciated that various modifications, changes, omissions, and substitutions can be made without departing from the spirit of the disclosure. It is intended, therefore, that the methods, apparatus and related aspects be limited solely by the scope of the following claims. It should be noted that the abovementioned examples illustrate rather than limit what is described herein, and that those skilled in the art will be able to design many alternative implementations without departing from the scope of the appended claims. Features described in relation to one example may be combined with features of another example.

Unless otherwise stated, the features of any dependent claim can be combined with the features of any of the other dependent claims, and any other independent claim.

The invention claimed is:

1. A cleaning unit for removing debris particles from a LEP ink transfer surface, the cleaning unit comprising:

a cleaning roller;

a wetting module to supply cleaning fluid to the cleaning roller; and an extractor to remove cleaning fluid and debris particles from the cleaning roller;

wherein the extractor comprises a vacuum chamber with a number of spaced vacuum nozzles, wherein the vacuum chamber has a waved form in that a distance between a vacuum nozzle and the surface being cleaned is less than a distance between points on a wall between the vacuum nozzles and the surface being cleaned.

2. The cleaning unit of claim 1, wherein the wetting module comprises a cleaning fluid duct for directly supply cleaning fluid to the cleaning roller.

3. The cleaning unit of claim 1, wherein the extractor comprises an extractor duct through which debris particles and cleaning fluid are removed from a microcellular material outer layer of the cleaning roller.

4. The cleaning unit of claim 3, wherein the extractor duct is in fluid communication with a vacuum source to generate a pressure gradient to remove debris particles and cleaning fluid from the microcellular material outer layer of the cleaning roller.

5. The cleaning unit of claim 3, wherein the extractor comprises a scrubber positioned within the extractor duct and engageable with the cleaning roller to aid removal of debris particles from the cleaning roller.

6. The cleaning unit of claim 1, wherein the cleaning roller comprising a microcellular material outer layer comprising open cell pores.

7. The cleaning unit of claim 6, wherein the open cell pores of the microcellular material outer layer have a diameter of less than about 50 μm.

8. The cleaning unit of claim 6, wherein the microcellular material outer layer has an Asker C hardness in a range of 10-20.

9. The cleaning unit of claim 6, wherein the microcellular material outer layer of the cleaning roller is disposed over a separate sponge inner layer of the cleaning roller.

10. The cleaning unit of claim 6, wherein the cleaning roller comprises a non-porous cylindrical core over which the microcellular material outer layer is disposed.

11. The cleaning unit of claim 1, wherein the extractor leaves some cleaning fluid on the LEP ink transfer surface, the cleaning unit further comprising a wiper blade to further wipe the cleaning fluid on the LEP ink transfer surface as the LEP ink transfer surface leaves the cleaning unit.

12. A cleaning unit for removing debris particles from a LEP ink transfer surface, the cleaning unit comprising:

a cleaning roller comprising a microcellular material outer layer comprising open cell pores having a diameter smaller than the particle size of the debris particles; and a wetting module to supply cleaning fluid to the cleaning roller;

wherein the microcellular material outer layer of the cleaning roller is disposed over a separate sponge inner layer of the cleaning roller.

13. The cleaning unit of claim 12, further comprising an extractor to remove cleaning fluid and debris particles from the cleaning roller.

14. The cleaning unit of claim 13, wherein the extractor comprises a vacuum chamber with a number of spaced vacuum nozzles, wherein the vacuum chamber has a waved form in that a distance between a vacuum nozzle and the surface being cleaned is less than a distance between points on a wall between the vacuum nozzles and the surface being cleaned.

15. The cleaning unit of claim 12, wherein the extractor comprises an extractor duct through which debris particles and cleaning fluid are removed from the microcellular material outer layer of the cleaning roller, wherein the extractor duct is in fluid communication with a vacuum source to generate a pressure gradient to remove debris particles and cleaning fluid from the microcellular material outer layer of the cleaning roller.

16. The cleaning unit of claim 15, wherein the extractor comprises a scrubber positioned within the extractor duct and engageable with the cleaning roller to aid removal of debris particles from the cleaning roller.

17. A cleaning unit for removing debris particles from a LEP ink transfer surface, the cleaning unit comprising:

a cleaning roller comprising a microcellular material outer layer comprising open cell pores having a diameter smaller than the particle size of the debris particles; and a wetting module to supply cleaning fluid to the cleaning roller;

wherein the cleaning roller comprises a non-porous cylindrical core over which the microcellular material outer layer is disposed.

18. The cleaning unit of claim 17, further comprising an extractor to remove cleaning fluid and debris particles from the cleaning roller.

19. The cleaning unit of claim 18, wherein the extractor comprises a vacuum chamber with a number of spaced vacuum nozzles, wherein the vacuum chamber has a waved form in that a distance between a vacuum nozzle and the surface being cleaned is less than a distance between points on a wall between the vacuum nozzles and the surface being cleaned.

20. The cleaning unit of claim 18, wherein the extractor comprises an extractor duct through which debris particles and cleaning fluid are removed from the microcellular material outer layer of the cleaning roller, wherein the extractor duct is in fluid communication with a vacuum source to generate a pressure gradient to remove debris particles and cleaning fluid from the microcellular material outer layer of the cleaning roller.

* * * * *